US005156089A

United States Patent [19]

McCue et al.

[11] Patent Number: 5,156,089

[45] Date of Patent: Oct. 20, 1992

[54] METHOD AND APPARATUS FOR MAKING A PAINTING SCREEN USING AN INK JET PRINTER FOR PRINTING A GRAPHIC ON THE SCREEN EMULSION

[75] Inventors: Geoff McCue, Lawrence, Kans.; Leonard G. Rich, West Hartford, Conn.; Mark E. Guckin, Middletown, Conn.; Russell F. Croft, Tolland, Conn.; Jay T. Niland, Meriden, Conn.

[73] Assignee: Gerber Scientific Products, Inc., Manchester, Conn.

[21] Appl. No.: 628,620

[22] Filed: Dec. 17, 1990

[51] Int. Cl.[5] ..... B41C 1/04; B41C 1/14

[52] U.S. Cl. ..... 101/128.4; 346/140 R

[58] Field of Search ..... 101/128.4, 128.21, 127, 101/129, 453, 460, 461, 467; 430/308; 346/140 R, 1.1

[56] References Cited

U.S. PATENT DOCUMENTS

| | | | |
|---|---|---|---|
| 485,602 | 11/1892 | Bell | 101/128.21 |
| 2,056,427 | 10/1936 | Gomes | 430/308 |
| 2,557,352 | 6/1951 | Kanitz | 101/128.21 X |
| 2,969,732 | 5/1955 | Kendall | 101/128.21 X |
| 3,467,004 | 9/1969 | Best et al. | 101/35 |
| 3,643,597 | 2/1972 | Lala | 101/128.21 X |
| 3,824,117 | 7/1974 | Anderson | 101/128.21 |
| 3,867,882 | 2/1975 | Ahlgren et al. | 101/35 |
| 3,974,767 | 8/1976 | Hagelberg | 101/151 |
| 4,203,360 | 5/1980 | Madwed | 101/129 |
| 4,209,582 | 6/1980 | Merrill et al. | 430/308 |
| 4,226,181 | 10/1980 | Ericsson | 101/129 |
| 4,278,022 | 7/1981 | Fitzpatrick et al. | 101/129 |
| 4,477,557 | 10/1984 | Rauch | 430/308 |
| 4,708,057 | 11/1987 | Hogenson | 101/129 |
| 4,718,340 | 1/1988 | Love, III | 101/116 |
| 4,816,295 | 3/1989 | Cardinale | 101/129 X |
| 4,833,486 | 5/1989 | Zerillo | 101/453 X |
| 4,958,564 | 9/1990 | Fuhrmann et al. | 101/467 |
| 4,981,765 | 1/1991 | Mizuguchi | 430/5 |

FOREIGN PATENT DOCUMENTS

| | | | |
|---|---|---|---|
| 548701 | 11/1957 | Canada | 101/128.21 |
| 0065760 | 12/1982 | European Pat. Off. . | |
| 5376906 | 1/1980 | Japan . | |
| 57157107 | 3/1984 | Japan . | |
| 59-38425 | 9/1985 | Japan . | |
| 59278919 | 7/1986 | Japan . | |
| 60-108269 | 11/1986 | Japan . | |
| 60268947 | 6/1987 | Japan . | |
| 0094247 | 4/1988 | Japan | 101/128.21 |
| 2081470 | 7/1981 | United Kingdom | 101/128.4 |
| 2209018 | 4/1989 | United Kingdom . | |

*Primary Examiner*—Clifford D. Crowder

*Attorney, Agent, or Firm*—McCormick, Paulding & Huber

[57] ABSTRACT

A method for making a printing screen wherein a screen having an unexposed emulsion layer applied thereto is placed in a printing device, such as an ink jet printer, and a graphic is printed directly on the emulsion layer. The graphic is precisely and automatically positioned relative to the screen by orienting the screen with respect to the X, Y and Z printing axes of the printing device, alinging a selected location on the screen with a selected coordinate position on the X and Y printing axes and providing the printing device with data defining the graphic to be printed on the emulsion layer, data defining the dimensions of the screen, and data defining selected coordinates within the dimensions of the screen with which corresponding reference coordinates of the graphic are to register when the graphic is printed on the emulsion layer.

22 Claims, 3 Drawing Sheets

METHOD AND APPARATUS FOR MAKING A PAINTING SCREEN USING AN INK JET PRINTER FOR PRINTING A GRAPHIC ON THE SCREEN EMULSION

BACKGROUND OF THE INVENTION

The present invention covers a printing screen and a method and apparatus for making such a printing screen. More particularly, the present invention deals with a method and apparatus for forming and precisely positioning a graphic on a printing screen.

Screen printing of graphics onto articles of clothing and other print receiving objects is a common practice. Reduced to its basics, the screen printing process comprises the steps of placing the receiving object in a printing press, mounting in the press and over the receiving object a printing screen bearing the graphic to be printed, wherein the graphic is defined by open and closed pores of the screen, and printing the graphic on the object by transferring ink through the open pores of the screen to the receiving object by means of a roller or squeegee.

In the past, it has been the typical practice to make a printing screen in the following manner. First, the graphic to be printed is formed, usually as a positive, by photographically locating the graphic on a suitable transparent sheet. An unexposed light-sensitive emulsion is applied to the printing surface of the screen (the surface of the screen in contact with the receiving object), and the transparent sheet bearing the graphic is placed over the emulsion. The regions of the emulsion not covered by the graphic carried by the transparent sheet are then hardened or "fixed" by exposure to light directed through the transparent sheet and onto the screen, thereby permanently closing the pores of the screen covered by the fixed emulsion. The unexposed regions of the emulsion are subsequently washed off of the screen to provide an open-pored area or set of areas which, in conjunction with the adjoining area or areas of closed pores, define the graphic to be printed. Once the printing screen has been prepared, the graphic is ready to be printed onto the receiving object. This is done by mounting the printing screen in the press with the printing surface of the screen resting on the receiving object and then forcing ink through the open pores of the screen.

Each time a new graphic is to be printed on receiving objects, a corresponding printing screen bearing the desired artwork must be prepared. This is a time consuming and expensive step in the screen printing process, not only because the new artwork must be formed on the transparent sheet, but also because the graphic carried by the sheet must be precisely located with respect to both the printing screen and the printing press to insure that the printed graphic is properly positioned on the receiving object.

The problem of precisely positioning the graphic with respect to the screen and the press is particularly critical when printing a multi-colored graphic on the receiving object. Such a graphic requires a number of different printing plates, one for each color in the graphic. Thus, great care must be taken to insure that the print of one color applied to the receiving object precisely registers with the prints of the other colors.

It is an object of the present invention to provide a method and apparatus for preparing a printing screen which permits any desired graphic to be quickly and easily formed on a printing screen.

It is a further object of the present invention to provide a method and apparatus wherein the graphic to be printed is automatically positioned with respect to the printing screen as the graphic is being formed on the screen.

SUMMARY OF THE INVENTION

The present invention meets the above-stated objects by providing a method for making a printing screen which includes the steps of providing a screen having a printing surface, applying an unexposed light-sensitive emulsion layer to the printing surface and placing the screen with the emulsion layer applied to the printing surface in a printing mechanism capable of movement along X, Y and Z printing axes. The screen is oriented in the printing mechanism with respect to the X, Y and Z printing axes, and a selected location on the screen is aligned with a selected coordinate position on the X and Y printing axes. The printing mechanism is provided with data defining a graphic to be printed directly on the emulsion layer, data defining the dimensions of the screen, and data defining selected coordinates within the dimensions of the screen with which corresponding reference coordinates of the graphic are to register when the graphic is printed on the emulsion layer. A graphic is printed directly on the emulsion layer by means of the printing mechanism according to the data provided, and after the printing operation is complete, the emulsion layer is exposed using the printed graphic as an exposure mask. Once the emulsion layer has been exposed, the screen is washed to remove the graphic and the unexposed portions of the emulsion layer which the graphic covers.

The present invention also provides an apparatus for making a printing screen. The apparatus comprises means defining a support surface for supporting the screen and printing means for printing a graphic directly on the emulsion layer applied to the printing surface of the screen. The support surface and the printing means are movable relative to one another along X, Y and Z printing axes, and the apparatus also includes means for orienting the screen with respect to the X, Y and Z printing axes. The apparatus further includes means for aligning a selected location on the screen with a selected coordinate position on the X and Y printing axes. Means are provided for inputting and processing data defining the graphic to be printed on the emulsion layer, data defining the dimensions of the screen, and data defining selected coordinates within the dimensions of the screen with which corresponding reference coordinates of the graphic are to register when the graphic is printed on the emulsion layer. The apparatus also includes print control means for activating the printing means and moving the printing means and the support surface relative to one another according to the data to print the graphic directly on the emulsion layer.

DETAILED DESCRIPTION OF THE INVENTION

Figure 1:
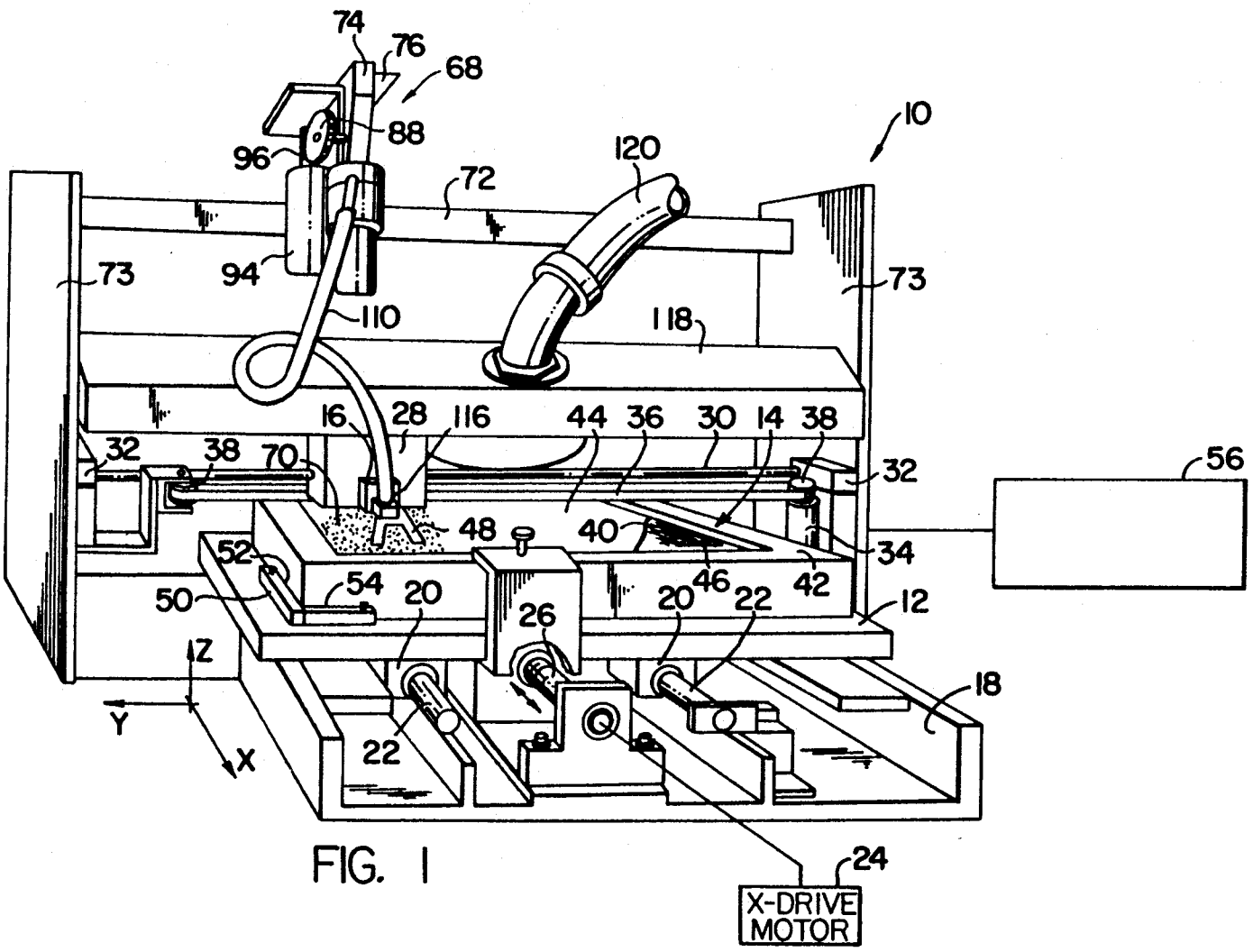
FIG. 1 is a perspective view of an apparatus for making a printing screen according to the invention.

FIG. 1 illustrates an apparatus according to the invention for making a printing screen. The apparatus, generally designated 10, includes a table 12, which supports a screen 14, and an ink jet printing head 16 which is supported above the table for movement in a plane generally parallel thereto. The table is supported on a frame 18 which includes blocks 20, 20 for slidably mounting the table on a pair of guide rails 22, 22. The table is movable along the rails along an illustrated X-coordinate printing axis by an X-drive motor 24 which turns a lead screw 26 threadably engaged with the frame 18. The printing head 16 is supported on a carriage 28 for movement along an illustrated Y-coordinate printing axis. The carriage is slidably mounted on guide rail 30 which extends across the table and is supported at both ends by adjustable support blocks 32, 32 which are constructed so as to provide the carriage 28 and the guide rail 30 with limited movement along the illustrated Z-coordinate print axis. A Y-drive motor 34 is driveably connected to the carriage 28 by means of a drive belt 36 and pulleys 38, 38.

Referring now to the screen 14 in more detail, the screen comprises a woven fabric 40, generally of polyester or nylon although silk is sometimes still used, stretched tightly over and affixed to a wooden or metal frame 42 to define a printing surface 46. An unexposed light-sensitive emulsion layer 44 is applied to the printing surface 46 of the screen. The emulsion layer may be applied to the surface 46 as, for example, a viscous liquid which is subsequently allowed to dry and harden. Alternatively, the emulsion layer may be applied as a sheet material such as, for example, the light-sensitive emulsion well known to those skilled in the screen printing art as capillary film. As illustrated in FIG. 1 and explained in more detail below, apparatus 10 prints a graphic, such as the graphic 48 directly on the light-sensitive emulsion layer 44.

Continuing the description of apparatus 10, a guide 50 is mounted on the table 12. The guide comprises a guide surface 52 disposed along the X-coordinate printing axis and a guide surface 54 disposed along the Y-coordinate printing axis. Thus, when the screen 14 is placed on the table 12 with a corresponding segment of the frame 42 adjacent to and in contact with the guide surfaces 52 and 54, the screen will be properly oriented in the apparatus 10 with respect to the X and Y printing axes. The guide surfaces 52 and 54 are mounted for movement relative to one another. Accordingly, by adjusting the position of the guide surfaces, the screen can be moved to a number of different coordinate positions along the X and Y print axes. This permits a selected location on the screen to be aligned with the home position of the printing head 16, that is, the X-Y coordinate position of the head at the beginning of a printing operation. Such an alignment is necessary to insure that the printed graphic is properly located on the screen.

The screen is properly oriented with respect to the Z printing axis by adjusting the support blocks 32, 32 to either raise or lower the printing head 16 supported by the carriage 28 relative to the printing surface 46 of the screen. Moreover, by adjusting the support blocks 32, 32 to raise or lower either end of the guide rail 30 with respect to the table 12, the printing surface 46 is located precisely perpendicular to the Z axis at a fixed position on the Z axis relative to the printing head.

Figure 2:
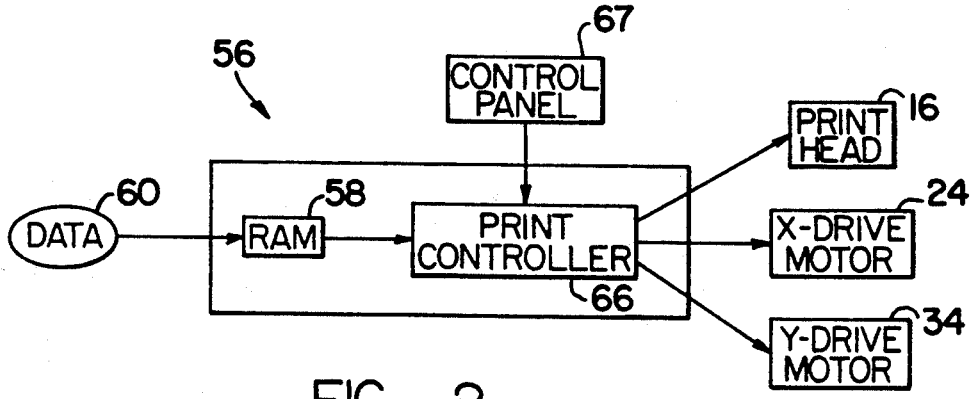
FIG. 2 is a block diagram of the control computer which forms a part of the apparatus illustrated in FIG. 1.

Referring now to FIGS. 1 and 2, the apparatus 10 further comprises a control computer 56 which includes Random Access Memory (RAM) 58 for receiving and storing data 60 defining a particular graphic, such as the graphic 48, to be printed. The data 60 also includes data defining the dimensions of the screen, and data defining selected coordinates within the dimensions of the screen with which corresponding reference coordinates of the graphic are to register when the graphic is printed on the emulsion layer 44. The computer also includes a control panel 67 through which a user may interact with the computer.

The data input in the control computer may be produced on an associated graphics generating device (not shown) such as, for example, a scanner, CAD system or other computer-based graphics generating device. Such devices are well known to those skilled in the art and will not be discussed further except to state that in the most preferred embodiment of the invention the graphics generating device includes all of the standard graphics editing and scaling functions. The graphics generating device may be an "on line" system communicating directly with the control computer 56, or it may be a stand alone system in which case the data 60 produced on the system is stored, for example, on a magnetic disc. In the latter case, the apparatus 10 further includes a memory storage device (not shown) for receiving and storing the data produced on the graphics generating device and for communicating that data to the computer 56.

Regardless of how the data 60 are created and input to the computer, the data stored in the RAM 58 are processed by a print controller 66 and converted into print commands. Once the screen has been properly orientated with respect to the X, Y and Z printing axes and a selected location on the screen has been aligned with the home position of the printing head, the print commands are transmitted by the print controller 66 to the printing head 16 and the X and Y drive motors 24 and 34. The printing head 16 is activated and the drive motors move the table 12 and the printing head 16 relative to one another in response to the print commands generated and transmitted by the control computer in accordance with the data. In this manner, the printing head is translated over the entire surface of the screen to print the graphic 48 directly on the emulsion layer 44 and to precisely and automatically position the graphic with respect to the screen. Because the apparatus 10 precisely positions the graphic on the screen 14, the time and effort needed to mount the screen in the printing press with the graphic properly located relative to the press is substantially reduced over that currently required of persons skilled in the screen printing art.

As noted previously, the printing head 16 is an ink jet printing head. While such a printing head forms a part of the particular embodiment of the invention described, the invention is, of course, in no way limited in this regard. A thermal printing head and an associated thermal printing ribbon may, for example, be employed instead. However, in the case where an ink jet printing head is used to print the graphic on the emulsion layer it has been found particularly advantageous to provide the emulsion layer with an ink receptive material prior to printing the graphic. The ink receptive material is employed to enhance the visual qualities of the ink printed on the emulsion and generally comprises, either alone or in combination, an adsorbent, surfactant or wetting agent which prevents the ink from beading on the emulsion layer. The ink receptive agent may be directly incorporated into the emulsion layer or the printing ink or both. The ink receptive material may also be applied to the surface of the emulsion layer in the form of a liquid film or a thin coating of powder.

Figure 4:
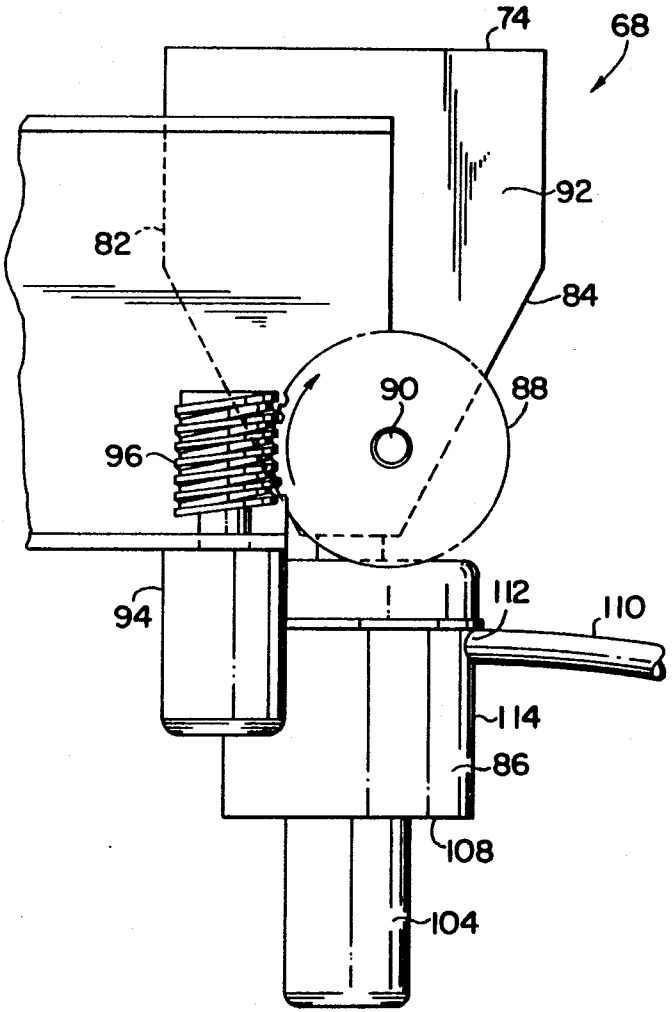
FIG. 4 is a fragmentary side view of the device illustrated in FIG. 3.
Figure 3:
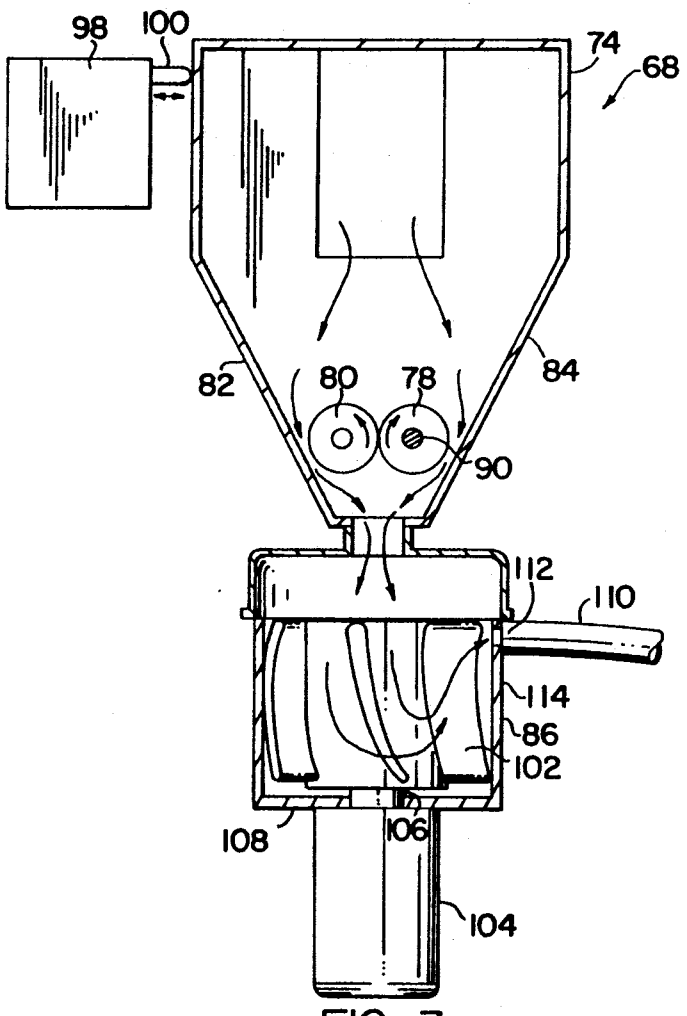
FIG. 3 is a sectional view of a device which coats a powdered substance on the surface of an unexposed light-sensitive emulsion layer and which forms a part of the apparatus illustrated in FIG. 1.

In the most preferred embodiment of the invention, the ink receptive material comprises finely divided talc. As shown in FIGS. 1, 3 and 4, the apparatus 10 includes a device, generally designated 68, for coating the talc 70, or other suitable powdered materials, on the emulsion layer 44. The device 68 is mounted on a horizontal support 72 extending between vertical supports 73, 73 and includes a hopper 74 for storing a quantity of talc. The hopper is provided with a fill spout 76 to facilitate the task of filling the hopper.

Referring now in particular to FIGS. 3 and 4, the talc is removed from the hopper by meshed feed gears 78, 80 mounted within the hopper. As illustrated by the arrows in FIG. 3, the talc is directed by the feed gears outwardly against the side walls 82, 84 of the hopper and downwardly into a chamber 86. The feed gears 78, 80 are rotated by a drive gear 88 mounted on the outside of the hopper. The drive gear 88 is drivingly connected to gear 78 by a shaft 90 extending through wall 92 of the hopper. The drive gear is itself driven by motor 94 and worm gear 96.

To prevent caking of the finely divided talc in the hopper and to insure that the talc flows continuously to the feed gears, the device 68 further includes an associated vibrator 98 mounted on the outside of the hopper. The vibrator comprises a reciprocating hammer 100 activated by, for example, a solenoid (not shown). The hammer continuously strikes the side wall 82 of the hopper while the device 68 is operating to promote the movement of the talc from the upper portion of the hopper to the feed gears.

The chamber 86 into which the talc is fed houses an impeller 102 which is rotated by a motor 104 connected to the impeller by a shaft 106 which extends through the bottom wall 108 of the chamber. The talc entering the chamber 86 is forced by the impeller through a flexible hose 110. One end 112 of the hose 110 opens into the chamber through the side wall 114 of the chamber. The other end 116 of the hose is mounted on the carriage 28 adjacent the printing head 16. In the most preferred embodiment of the invention the device 68 is activated immediately prior to the activation of the print head 16 to deposit a coating of talc on the emulsion layer 44. The device operates continually during the printing operation and applies the talc just ahead of the print head's location on the emulsion layer. As those skilled in the art will appreciate, the motor 94 may be controlled by the computer 56 in either an on/off mode or in a speed control mode to optimize the talc coating according to the performance of the printer and the nature of the graphic.

Since the coating material is finely divided talc it is to be expected that a portion of the talc exiting the hose 110 will not deposit on the emulsion layer but will, instead, remain airborne for a period of time. Accordingly, as shown in FIG. 1, the apparatus 10 further includes a hood 118 and an associated vacuum hose 120 mounted across table 12 between vertical supports 32, 32. Vacuum is applied through the hose 120 simultaneously with the activation of the device 68 to remove any talc which exits the hose but does not deposit on the emulsion layer.

Figure 5:
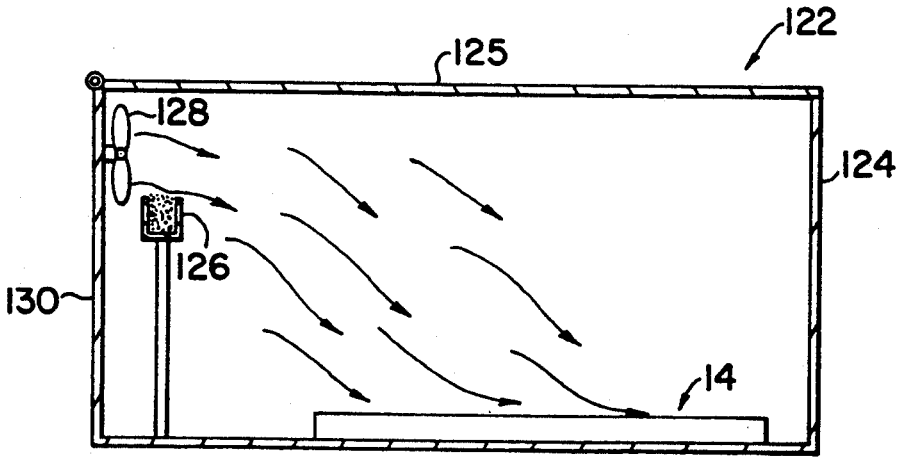
FIG. 5 is a side view of stand-alone device for applying a coating of powder on the surface of an unexposed light-sensitive emulsion layer.

FIG. 5 illustrates a stand-alone device for applying the talc coating to the emulsion layer. The device 122 comprises an enclosure 124 large enough to contain the screen 14. The enclosure is provided with a hinged access door 125 through which the screen may be inserted and removed from the enclosure. The device 122 further includes an open container 126 for holding a quantity of talc. A small electric fan 128 mounted on the side wall 130 of the enclosure directs a stream of air into the enclosure. The air stream produced by the fan blows the talc out of the container creating a cloud of finely divided talc which fills the enclosure. After the cloud has been formed, the fan is turned off, and the airborne talc settles to form a thin coating on the surface of the emulsion layer. The screen is then removed from the device 122 and positioned in the apparatus 10 and the graphic is printed on the emulsion layer.

Once the graphic has been printed on the emulsion layer 44, the screen is removed from the apparatus 10 and the emulsion is exposed in an illuminator (not shown). Such illuminators are well known to those skilled in the art and generally comprise a lamp having a high blue, violet or ultraviolet content. As explained previously, the portions of the emulsion layer 44 not covered by the graphic are "fixed" or hardened by exposure to the light to provide an area or areas of closed pores on the screen. Conversely, those portions of the emulsion layer covered by the graphic 48 are protected from exposure to the light and are subsequently washed from the screen with water, together with the graphic which is preferably formed with water soluble ink, to provide an area or areas of open pores. Thus, after the washing is complete, the areas of open and closed pores on the screen define the graphic 48. Moreover, because the control computer is provided not only with data defining the graphic, but also with data defining the dimensions of the screen, and data defining selected coordinates within the dimensions of the screen with which corresponding reference coordinates of the graphic are to register when the graphic is printed on the emulsion layer, the apparatus 10 precisely and automatically locates the graphic with respect to the screen. As noted previously, precisely locating the graphic with respect to the screen makes the task of mounting the screen in the printing press with the graphic located correctly relative to the press considerably easier.

By the foregoing, a printing screen and a method and apparatus for making such a printing screen which embody the present invention have been disclosed. However, numerous modifications and substitutions may be made without deviating from the scope of the invention. For example, as mentioned previously, a thermal printing head with an associated thermal printing ribbon may be substituted for the ink jet printing head 16. Also, the carriage 28 may carry a plurality of printing heads to reduce the time required to print a graphic on the emulsion layer. Also, if desired, the apparatus 10 may be constructed so that the table 12 remains stationary and the carriage 28 is moved in both the illustrated X and Y coordinate directions to print the graphic on the emulsion layer. Furthermore, a standalone device for coating the screen with an ink receptive powder could be provided comprising a spray gun, such as an electrostatic spray gun, and a mount for positioning the screen 14 so that powder ejected by the gun is deposited as a thin coating on the surface of the emulsion layer. Therefore, the invention has been disclosed by way of example and not limitation.

We claim:

1. A method for preparing a printing screen printing, said method comprising the steps of:

providing a screen having a printing surface;

applying an unexposed light sensitive emulsion layer to said printing surface;

providing a printing mechanism, said printing mechanism capable of movement along X, Y and Z printing axes;

positioning said screen with the emulsion layer applied to said printing surface in said printing mechanism with the screen oriented with respect to the X, Y and Z printing axes and a selected location on the screen aligned with a selected coordinate position on the X and Y printing axes;

providing the printing mechanism with data defining a graphic to be printed on the emulsion layer, data defining the dimensions of the screen, and data defining selected coordinates within the dimensions of the screen with which corresponding reference coordinates of the graphic are to register when the graphic is printed on the emulsion layer;

printing the graphic on the emulsion layer by means of the printing mechanism according to the data provided;

exposing the emulsion layer using the printed graphic as an exposure mask, and washing the screen to remove unexposed portions of the emulsion layer.

2. The method of claim 1 further characterized in that the printing mechanism comprises at least one ink jet printing head.

3. The method of claim 2 wherein prior to the step of printing the graphic on the emulsion layer, the method further comprises the step of:

providing the emulsion layer with an ink receptive material.

4. The method of claim 3 wherein the step of providing the emulsion layer with an ink receptive material is further characterized in that the emulsion layer is coated with a layer of ink receptive powder.

5. The method of claim 4 further characterized in that the powder is finely divided talc.

6. The method of claim 3 wherein the step of providing the emulsion layer with an ink receptive material is further characterized in that the ink receptive material is incorporated into the light-sensitive emulsion prior to applying said emulsion layer to said printing surface.

7. The method of claim 3 wherein the step of providing the emulsion layer with an ink receptive material is further characterized in that the ink receptive material is incorporated into the printing ink.

8. The method of claim 3 wherein the ink receptive material is incorporated into the printing ink and the light-sensitive emulsion.

9. The method of claim 3 wherein said ink receptive material is selected from the group consisting of adsorbents, surfactants, wetting agents and mixtures thereof.

10. The method of claim 1 further characterized in that the printing mechanism comprises at least one thermal printing head having an associated thermal printing ribbon.

11. The method of claim 1 wherein the step of applying the emulsion layer is further characterized in that the emulsion layer is applied to the printing surface of the screen as a liquid which is allowed to dry and harden prior to the step of printing the graphic.

12. The method of claim 1 wherein the step of applying the emulsion layer is further characterized in that the emulsion layer is applied to the printing surface of the screen as a sheet material comprising a light-sensitive emulsion.

13. The method of claim 12 wherein the step of applying the emulsion layer is further characterized in that the sheet material is capillary film.

14. The method of claim 1 wherein prior to the step of providing the printing mechanism with data, the method further comprises the steps of:

creating a computer generated representation of the graphic on a graphics generating device, and editing and scaling the created representation.

15. The method of claim 1 wherein the step of exposing and developing the emulsion layer is further characterized in that the emulsion layer is exposed in an illuminator comprising a lamp which emits light having a high content of light selected from the group consisting of blue light, violet light and ultra violet light.

16. An apparatus for preparing a printing screen, said apparatus comprising:

means defining a support surface for supporting a screen, said screen having a printing surface with an unexposed light-sensitive emulsion layer applied thereto;

printing means for printing a graphic on said emulsion layer, said printing means and said support surface movable relative to one another in X, Y and Z printing axes;

means for orienting said screen with respect to the X, Y and Z printing axes;

means for inputting, storing and processing data defining the graphic to be printed on the emulsion layer, data defining the dimensions of the screen, and data defining selected coordinates within the dimensions of the screen with which corresponding reference coordinates of the graphic are to register when the graphic is printed on the emulsion layer;

means for aligning a selected location on said screen with a selected coordinate position relative to said X and Y printing axes so that said data defining selected coordinates within the dimension of the screen register with said corresponding reference coordinates of the graphic when the graphic is printed on the emulsion layer, and print control means for activating said printing means and moving said printing means and said support surface relative to one another according to said data to print said graphic on said emulsion layer.

17. The apparatus of claim 16 further comprising:

means for creating a computer generated representation of the graphic to be printed, and means for editing and scaling the created representation.

18. The apparatus of claim 16 wherein said printing means comprises at least one thermal printing head and an associated thermal printing ribbon.

19. The apparatus of claim 16 wherein said printing means comprises at least one ink jet printing head.

20. An apparatus for preparing a printing screen, said apparatus comprising:

means defining a support surface for supporting a screen, said screen having a printing surface with an unexposed light-sensitive emulsion layer applied thereto;

means for providing said emulsion layer with an ink receptive material;

at least one ink jet printing head for printing a graphic on said emulsion layer, said printing means and said support surface movable relative to one another in X, Y and Z printing axes;

means for orienting said screen with respect to the X, Y and Z printing axes;

means for inputting, storing and processing data defining the graphic to be printed on the emulsion layer, data defining the dimensions of the screen, and data defining selected coordinates within the dimensions of the screen with which corresponding reference coordinates of the graphic are to register when the graphic is printed on the emulsion layer;

means for aligning a selected location on said screen with a selected coordinate position relative to said X and Y printing axes so that said data defining selected coordinates within the dimension of the screen register with said corresponding reference coordinates of the graphic when the graphic is printed on the emulsion layer, and print control means for activating said printing means and moving said printing means and said support surface relative to one another according to said data to print said graphic on said emulsion layer.

21. The apparatus of claim 20 wherein said ink receptive material is a powder and said apparatus further comprises:

means for storing a quantity of said powder, and means for continuously removing said powder from said storage means.

22. The apparatus of claim 21 further comprising:

means for depositing a coating of said powder removed from said storage means on said emulsion layer.

* * * * *

UNITED STATES PATENT AND TRADEMARK OFFICE

CERTIFICATE OF CORRECTION

PATENT NO. : 5,156,089

DATED : October 20, 1992

INVENTOR(S) : McCue et al.

It is certified that error appears in the above-identified patent and that said Letters Patent is hereby corrected as shown below:

On the title page, item [54] and column 1, line 3, delete "PAINTING" and insert --PRINTING--.

Signed and Sealed this

Fifteenth Day of February, 1994

*Attest:*

*Attesting Officer*

Bruce Lehman

BRUCE LEHMAN

*Commissioner of Patents and Trademarks*